US006783472B1

(12) United States Patent
Stanford et al.

(10) Patent No.: US 6,783,472 B1
(45) Date of Patent: Aug. 31, 2004

(54) FLEXURE RESISTANT BASE PLATE FOR A BASKETBALL GOAL ASSEMBLY

(75) Inventors: Carl R. Stanford, Clinton, UT (US); David C. Winter, Layton, UT (US); Brandon C. Smith, Ogden, UT (US); Charles Monsen, Brigham City, UT (US)

(73) Assignee: Lifetime Products, Inc., Clearfield, UT (US)

( * ) Notice: Subject to any disclaimer, the term of this patent is extended or adjusted under 35 U.S.C. 154(b) by 0 days.

(21) Appl. No.: 10/051,454

(22) Filed: Jan. 18, 2002

(Under 37 CFR 1.47)

Related U.S. Application Data

(60) Provisional application No. 60/263,082, filed on Jan. 19, 2001.

(51) Int. Cl.[7] ..... A63B 63/08
(52) U.S. Cl. ..... 473/481; 248/650
(58) Field of Search ..... 473/481; 248/650, 248/188; 52/96, 296, 295; 400/124

(56) References Cited

U.S. PATENT DOCUMENTS 3,311,333 A * 3/1967 Galloway ..... 52/295
3,544,110 A 12/1970 Dickinson ..... 273/1.5
4,951,944 A 8/1990 Morgan ..... 273/1.5 R
5,156,395 A * 10/1992 Smith ..... 473/483
5,211,393 A 5/1993 Rolffs et al. ..... 273/1.5 R
5,601,284 A 2/1997 Blackwell et al. ..... 473/483
5,913,778 A * 6/1999 Hying et al. ..... 52/40

OTHER PUBLICATIONS

Web Page: Garhauer catalog, 2001, www.garhauermarine.com, 9 pages.*

* cited by examiner

*Primary Examiner*—Stephen P. Garbe
*Assistant Examiner*—M. Chambers
(74) *Attorney, Agent, or Firm*—Workman Nydegger

(57) ABSTRACT

A mounting assembly for permanently mounting a basketball goal assembly is provided. The mounting assembly may include a base plate with holes configured to fit over retaining members, which may take the form of J-bolts. The mounting assembly preferably has a shorter span of base plate material located between holes on the front side of the base plate, so that bending of the base plate is reduced and vibration of the backboard is not sufficient to disturb game play. The span may be shortened by providing an intermediate support member underneath the base plate, positioned between the front holes, by making the front holes closer together, by affixing the pole toward the front end of the base plate, or any combination thereof. Preferably, the front holes are elongated to form slots so that the front end of the base plate can rest on the ground while the basketball goal assembly is pivoted into position over the retaining members.

23 Claims, 4 Drawing Sheets

FLEXURE RESISTANT BASE PLATE FOR A BASKETBALL GOAL ASSEMBLY

RELATED APPLICATIONS

This application claims the benefit of U.S. Provisional Application No. 60/263,082 filed Jan. 19, 2001 and entitled FLEXURE RESISTANT BASE PLATE FOR A BASKETBALL GOAL ASSEMBLY, which is incorporated herein by reference.

BACKGROUND OF THE INVENTION

1. The Field of the Invention

The present invention relates to basketball goal assemblies. More specifically, the present invention relates to a mounting assembly for mounting a heavy-duty basketball goal assembly with comparative ease and vibration resistance.

2. The Relevant Technology

Basketball is an increasingly popular sport in the United States and abroad. There are many cities, counties and other associations that sponsor recreational and instruction leagues where people of all ages can participate in the sport of basketball. Today there are organized leagues for children as young as five and six years old. Accordingly, is not surprising that more and more people have a basketball goal assembly mounted on their own property.

Home basketball assemblies are generally either portable or permanently-mounted. Portable basketball assemblies typically are comparatively lightweight, with a weighted base that can be transported from one location to another through the use of wheels or the like. Permanently-mounted basketball assemblies, on the other hand, are typically larger and heavier and are designed to be fixed permanently in place through the use of a concrete mounting block or a similar mounting structure. Thus, permanently-mounted assemblies are often more stable, and can therefore provide a better playing experience.

However, permanently-mounted assemblies are often somewhat difficult to assemble, in part because of the way in which such assemblies are typically mounted. Normally, such a basketball goal assembly is mounted on a concrete block with four protruding bolts in a square configuration. A base plate affixed to the basketball goal assembly has holes in a square configuration like that of the bolts. The entire basketball goal assembly must typically be lifted off the ground, in a vertical orientation, and then set down so that each hole of the base plate is aligned with a bolt. As mentioned above, permanently-mounted assemblies are typically heavy-duty. Consequently, the task of lifting such a base up in the vertical orientation, moving it over the bolts, and aligning the holes of the base plate with the bolts is a difficult operation that normally requires the use of several strong adults, if suitable hoisting machinery is not available.

Prior to installation of the base plate, a nut is typically threaded onto each bolt so that the base plate rests on several nuts. Each nut can be independently raised or lowered by twisting the nut. Thus, in the case of a square, four-bolt configuration, each corner of the base plate can be independently raised or lowered. Such a configuration has the advantage of permitting relatively simple adjustment of the orientation of the backboard so that the backboard can be leveled appropriately. However, only the corners of the base plate are supported; the center of the base plate is suspended over the concrete surface. As a result, the center of the base plate may be pressed downward or may be tilted during game play.

Accordingly, despite the additional structural material used to form such heavy-duty assemblies, known goal assemblies often are not rigid enough to prevent motion or vibration of the backboard during game play. When a player puts significant weight on the goal through a maneuver such as slam dunking, that weight is transmitted through the structure of the basketball goal assembly to the base plate. Under the user's weight, the base plate tends to elastically deform somewhat; although the deformations are small, they are multiplied through the length of the pole so that significant motion of the backboard occurs. The result is a vibration that gives the impression of instability, and can even cause basketballs to rebound unpredictably from the backboard.

Known basketball goal mounting assemblies designed to have enhanced stiffness or easy assembly are typically ineffective because they do not permit easy leveling of the basketball goal. For example, mounting assemblies that utilize a hinged base plate to facilitate pivotal installation of the basketball goal assembly typically do not permit side-to-side adjustment of the orientation of the basketball goal assembly. Thus, the basketball goal cannot be leveled in the lateral direction. Assemblies in which the base plate directly abuts a flat concrete surface or template may have enhanced stiffness, but typically cannot be leveled at all.

Consequently, it would be an advancement in the art to provide a system and method for mounting a basketball goal assembly without lifting the assembly off the ground in the vertical orientation. Additionally, it would be an advancement in the art to provide a system and method for stiffening a basketball goal assembly to resist movement of the backboard during game play.

Preferably, such a basketball goal assembly should have a mounting assembly in which a standard sized concrete mounting block can be used. Thus, it is preferable to stiffen the goal assembly while changing the geometry of the base plate as little as possible. It would also be desirable to provide such a system and method in which the basketball goal assembly could be leveled front-to-back as well as side-to-side after the goal assembly has been mounted. The system and method is preferably operable by a user with a minimum of tooling and effort. Additionally, the system as a whole is preferably inexpensive and easy to manufacture.

BRIEF SUMMARY OF THE INVENTION

The apparatus of the present invention has been developed in response to the present state of the art, and in particular, in response to the problems and needs in the art that have not yet been fully solved by currently available basketball goal assemblies. Thus, it is an overall objective of the present invention to provide a system and method for mounting a basketball goal assembly without the need to fully lift the basketball goal assembly off the ground in the vertical orientation. It is also an overall objective of the present invention to provide a system and method for stiffening a basketball goal assembly against backboard motion.

To achieve the foregoing objects, and in accordance with the invention as embodied and broadly described herein in the preferred embodiment, a novel mounting assembly for a basketball goal assembly is provided. The mounting assembly preferably comprises a base plate with a plurality of holes. For example, four holes may be used, and may be arranged so that each hole is positioned at a vertex of a square. There may be two front holes and two rear holes.

Bending is generally proportional to the applied force and the moment arm applied by the force, and inversely proportional to its thickness and sectional modulus. The moment arm, in turn, is generally proportional to the length of the member. The present invention utilizes novel methods to decrease the effective length of the member in which the most bending occurs, or the span of the base plate between the two front holes. Several different methods are envisioned.

One possible method of decreasing bending in the base plate is to provide an intermediate support member positioned underneath the base plate, between the two front holes. Thus, the span of the base plate between the front holes is effectively split into two separate and shorter lengths, each of which receives half of the force applied against the base plate by the pole. The bending moment against each length is reduced so that overall bending of the base plate is smaller.

Alternatively, the two front holes in the base plate may be brought closer together. Thus, the holes of the base plate may form a trapezoidal, rather than a square, configuration. Once again, the length of the span of the base member between the two front holes is reduced to reduce bending.

As another alternative, the pole may be mounted closer to the front side of the base member than the rear side. Since the distance between the pole and the front holes is reduced, the span of the base member that experiences the bending stress will be shorter.

Any of the above methods may be utilized, alone or in combination, to reduce motion of the backboard of the basketball goal assembly. Alternatively, any other method that effectively reduces the size of the span of the base member between the front holes may be used.

The mounting assembly may also have features designed to enable the basketball goal assembly to be erected without lifting the entire assembly off of the ground. For example, the front holes of the base plate may be elongated to form slots so that the base plate can be pivoted over the front retaining members, or J-bolts. The rear holes may then slide over the rear retaining members in a near-vertical motion.

These and other objects, features, and advantages of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and objects of the invention are obtained will be readily understood, a more particular description of the invention briefly described above will be rendered by reference to specific embodiments thereof which are illustrated in the appended drawings. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

The presently preferred embodiments of the present invention will be best understood by reference to the drawings, wherein like parts are designated by like numerals throughout. It will be readily understood that the components of the present invention, as generally described and illustrated in the figures herein, could be arranged and designed in a wide variety of different configurations. Thus, the following more detailed description of the embodiments of the apparatus, system, and method of the present invention, as represented in FIGS. 1 through 4, is not intended to limit the scope of the invention, as claimed, but is merely representative of presently preferred embodiments of the invention.

Figure 1:
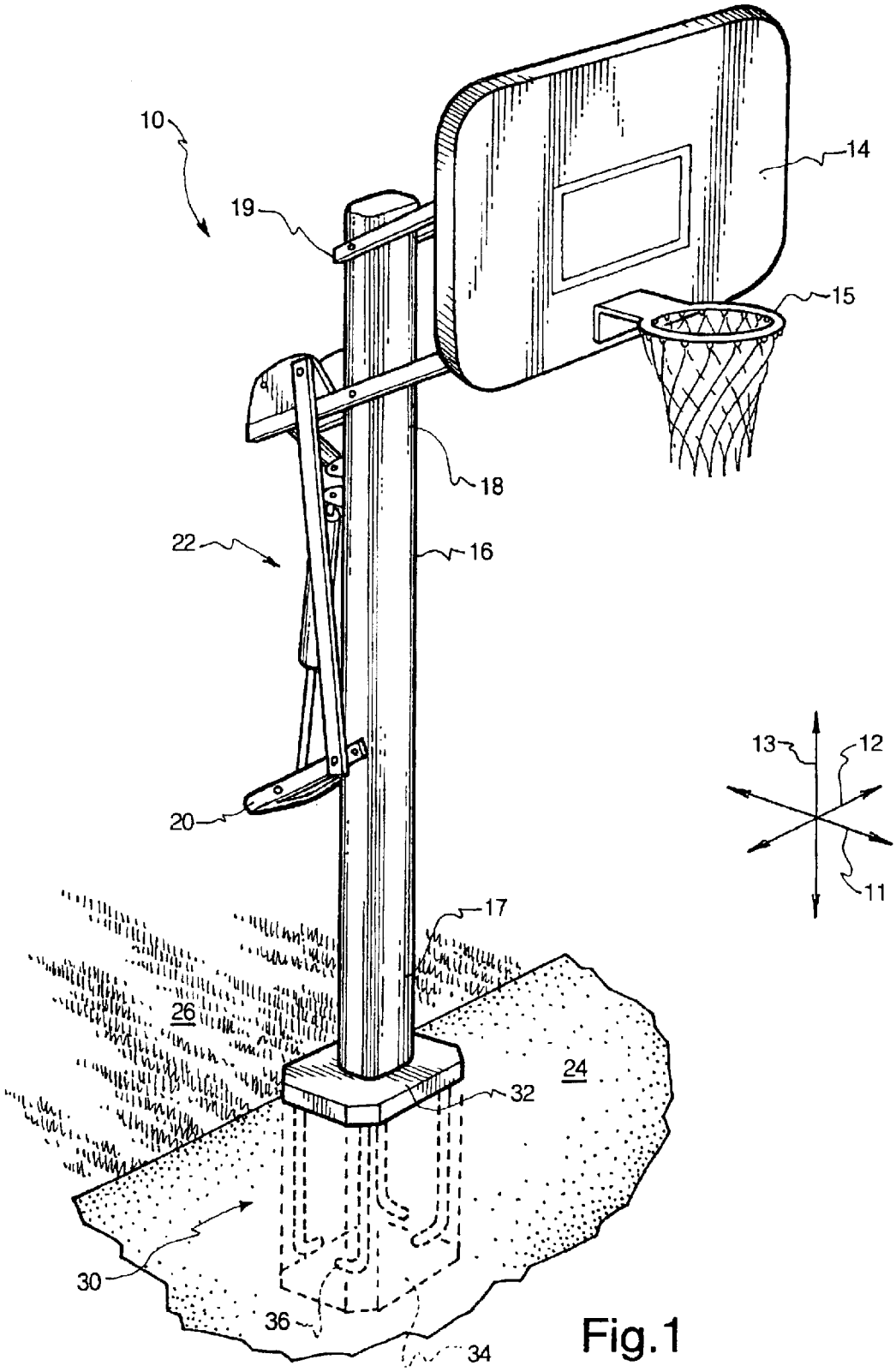
FIG. 1 is a perspective view of a portable basketball goal assembly mounted near a playing surface through the use of one possible mounting assembly of the invention.

Referring to FIG. 1, one embodiment of a basketball goal assembly 10 according to the invention is depicted. The basketball goal assembly 10 has a longitudinal direction 11, a lateral direction 12, and a transverse direction 13. A backboard 14 is oriented substantially vertically, with a goal 15 extending perpendicular to it. A pole 16 supports the backboard 14; the pole 16 may have a first end 17 and a second end 18. A deformable goal support structure 19 may permit adjustment of the vertical position of the backboard 14 along the pole 16. A handle 20 may be moved, pivotally or translationally, to reconfigure the deformable goal support structure 19 through the use of one or more connection members 22 connecting the handle 20 with the deformable goal support structure 19.

The basketball goal assembly 10 may be mounted permanently or semi-permanently on or at the edge of a playing surface 24, which preferably comprises a hard, flat surface constructed of concrete, asphalt, or wood. The basketball goal assembly 10 may, for example, be mounted at a surrounding area 26 near the playing surface 24. The basketball goal assembly 10 may be affixed to the surrounding area 26 through the use of a mounting assembly 30. The mounting assembly 30 may include a base plate 32 rigidly affixed to the first end 17 of the pole 16, an anchoring block 34, and a plurality of retaining members 36. The anchoring block 34 preferably comprises a heavy and stiff material such as concrete. The retaining members 36 may be seated within the anchoring block 34.

A "retaining member" is simply any type of member that operates, either alone or in combination with other members, to restrain respective motion between the base plate 32 and the anchoring block 34. The retaining members 36 may comprise elongated members such as J-bolts 36, as depicted in FIG. 1. In the alterative, retaining members may take the form of other fasteners, including clips, clamps, rivets, shaft and cotter pin systems, and the like.

Figure 2:
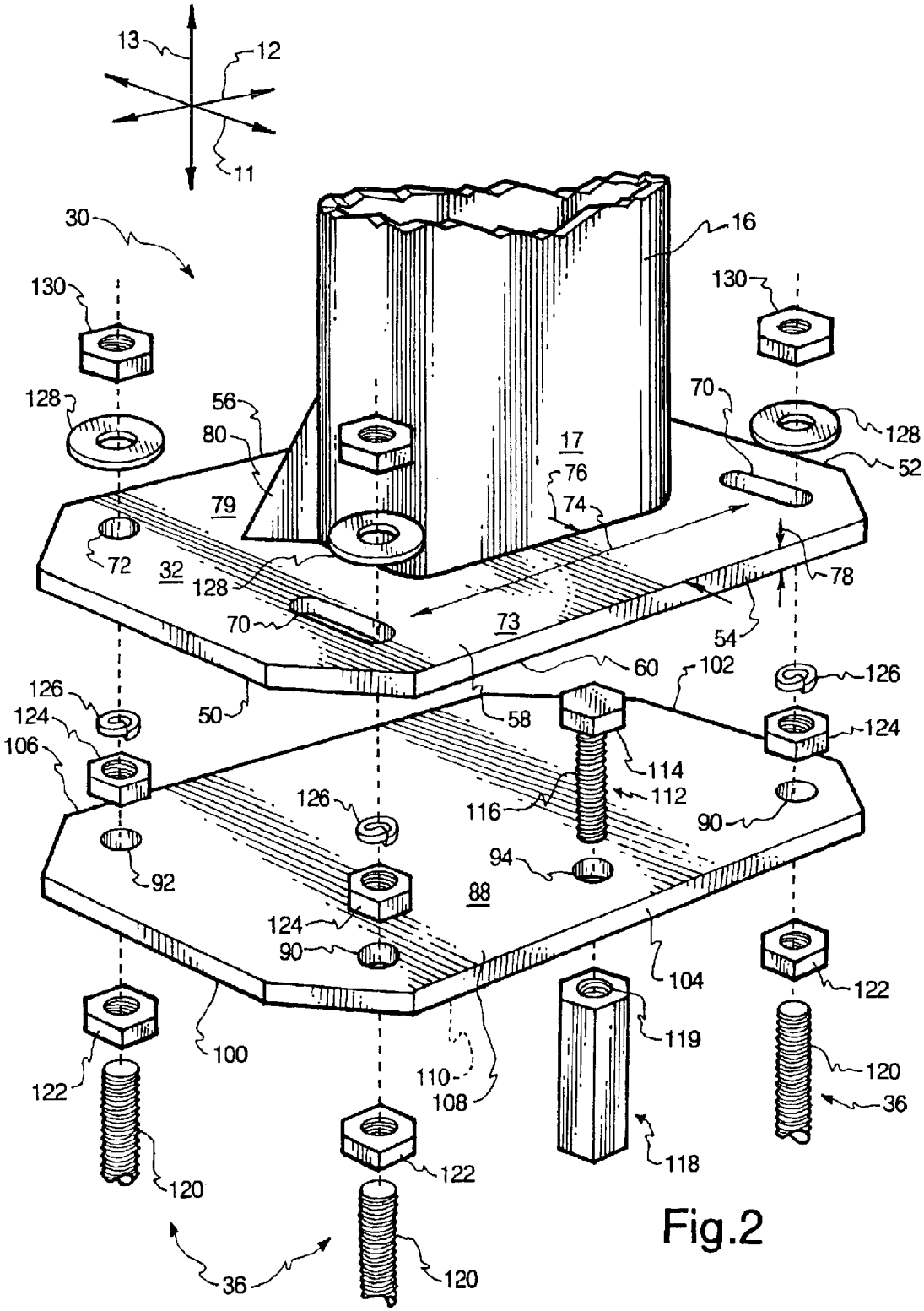
FIG. 2 is an exploded, perspective view of a portion of the mounting assembly of FIG. 1.

Referring to FIG. 2, an exploded view of a portion of the mounting assembly 30 is depicted in detail. The base plate 32 is preferably formed from a sheet of strong, stiff material such as steel. The base plate 32 may have a first lateral side 50, a second lateral side 52, a front side 54, and a rear side 56. Additionally, the base plate 32 may have a top side 58 on which the first end 17 of the pole 16 is attached and a bottom side 60 facing the anchoring block 34.

Preferably, the base plate 32 comprises front holes 70 positioned toward the front side 54 of the base plate 32 and rear holes 72 positioned toward the rear side 56. The front holes 70 are preferably elongated to form slots 70 through which exposed portions of the J-bolts 36 can pivot relative to the base plate 32 for easier positioning of the basketball goal assembly 10, in a manner to be described subsequently.

A front span 73 of the base plate 32 is located generally between the slots 70, forward of the first end 17 of the pole 16. The front span 73 has a length 74 defined by the distance between the slots 70 and a width 76 defined by the distance between the first end 17 of the pole 16 and the front end 54 of the base plate 32. The width 76 may be comparatively small due to the fact that the pole 16 is positioned nearer the front side 54 than the rear side 56. The base plate 32 also has a thickness 78, which may be uniform throughout the base plate 32, and may range from about one-quarter of an inch to about one inch. The thickness 78 may further range from about one-half inch to about three-quarters of an inch. According to certain embodiments, the thickness 78 may be about five-eighths of an inch.

The base plate 32 may also have a rear span 79 located generally between the holes 70 rearward of the first end 17 of the pole 16. Although dimensions of the rear span 79 are not depicted in FIG. 2, they may be substantially as shown and described in connection with the front span 73. Since the holes and slots 70 are in a generally rectangular configuration, the rear span 79 may have a length approximately equal to the length 74 of the front span 73. However, since the pole 16 is attached nearer the front side 54 than the rear side 56, the rear span 79 may have a width somewhat greater than the width 76 of the front span 73.

The greater width of the rear span 79 adds to the length of the base plate in the longitudinal direction 11, thereby enhancing the stability of the basketball goal assembly 10. Additionally, the width of the rear span 79 provides a comparatively longer lever arm extending forward from the J-bolts 36 disposed near the rear side 56. Hence, a smaller downward force is required to hold down the rear side 56 of the base plate 32 while downward force is applied against the rim 15. However, the greater width of the rear span 79 also tends to facilitate bending of the rear span 79. Additional members may be added to the mounting assembly 30 to reinforce the rear span 79 against bending. For example, gussets 80 may be affixed between the first end 17 of the pole 16 and the rear span 79 to stiffen the rear span 79 to at least partially offset the greater width of the rear span 79. The gussets 80 may also maintain the perpendicularity of the pole 16 with respect to the base plate 32.

Preferably, the base plate 32 is mounted over a template 88, which may then rest on the anchoring block 34 (not shown in FIG. 2). The template 88 preferably comprises front holes 90 and rear holes 92 in alignment with the slots 70 and holes 72 of the base plate 32, respectively. More specifically, the front holes 90 of the template 88 are preferably aligned with the front portion of the slots 70. An intermediate hole 94 may be positioned between the front holes 90. The template 88 is preferably also constructed of a stiff, strong material, such as steel. Like the base plate 32, the template 88 may also have a first lateral side 100, a second lateral side 102, a front side 104, a rear side 106, a top side 108, and a bottom side 110.

The template 88 may facilitate installation of the basketball goal assembly 10. More specifically, installation may commence with the creation of a hole in the surrounding area 26. The hole may advantageously be rectangular prismatic in shape, as depicted in FIG. 1, so that the basketball goal assembly 10 is unable to rotate with respect to the surrounding area 26. The hole may be filled with concrete through the aid of a form, as known in the art; rebar may also be applied to enhance the strength of the concrete. Hence, the anchoring block 34 may be created in a wet, malleable state. Before the anchoring block 34 sets, the J-bolts may be affixed to the template, and the template 88 may be seated on the anchoring block 34 such that the J-bolts extend downward, into the wet concrete.

Preferably, prior to placement of the template 88, an intermediate support member 112 is affixed to the template 88 through the intermediate hole 94. More specifically, the intermediate support member 112 may take the form of a bolt with a head 114 and a threaded portion 116. The threaded portion 116 may be inserted through the intermediate hole 94 to protrude from the bottom side 110 of the template 88. The threaded portion 116 may be engaged within a nut coupler 118 by inserting the threaded portion 116 into a threaded hole 119 of the nut coupler 118 and twisting the nut coupler 118 and intermediate support member 112 with respect to each other.

Each of the J-bolts 36 may have a threaded end 120; a bottom nut 122 may be inserted onto each of the threaded ends 120 and rotated into engagement. The threaded ends 120 may then be inserted into the holes 90, 92 of the template 88 until each of the bottom nuts 122 rests against the template 88. Intermediate nuts 124 may then be threaded onto the threaded ends 120 and rotated until they snugly abut the template 88. Hence, the J-bolts may be held in place with respect to the template 88 via the nuts 122 and 124, and the intermediate support member 112 may be likewise held in place by the nut coupler 118.

After the intermediate support member 112 and the J-bolts 36 have been attached to the template 88, the J-bolts 36 and the nut coupler 118 may be inserted into the wet concrete of the anchoring block 34 until the template 88 rests on top of the anchoring block 34, with the intermediate nuts 124 and the threaded ends 120 of the J-bolts 36 protruding above the template 88. Locking washers 126 may be inserted around each of the threaded ends 120, over the intermediate nuts 124. As the concrete sets, the nut coupler 118 and the J-bolts 36 are fixed in place in a non-rotatable fashion. More specifically, the hooked shape of the J-bolts 36 and the polygonal shape of the nut coupler 118 prevent significant rotation of the J-bolts 36 and the nut coupler 118 within the concrete of the anchoring block 34.

The base plate 32 may be placed upon a plurality of base supports, at least some of which are adapted to be fixed at a variety of vertical positions to provide leveling of the base plate 32. "Base supports" are simply devices, each of which has a smaller footprint than the base plate 32, that can be arranged underneath the base plate 32 to support the weight of the basketball goal assembly 10. Hence, the intermediate nuts 124 and the intermediate support member 112 may all operate as base supports. More specifically, the intermediate support member 112 and the intermediate nuts 124 disposed toward the front side 54 may be front base supports, and the intermediate nuts 124 disposed toward the rear side 56 may be rear base supports. One manner in which the base plate 32 may be easily disposed to rest upon the base supports, i.e., the intermediate nuts 124 and the intermediate support member 112, will be described below.

After the concrete has dried, the base plate 32 may be aligned with the J-bolts 36 and placed on the template 88 at an angle so that the threaded ends 120 pass through the slots 70. The base plate may then be pivoted into a parallel position with the template 88 in a manner that will be shown and described in connection with FIG. 3. Once the base plate 32 is parallel with the template 88 and is resting on top of the locking washers 126, flat washers 128 may be applied over the exposed threaded ends 120 against the top side 58 of the base plate 32, and top nuts 130 may be threaded onto the threaded ends 120 on top of the flat washers 128.

Preferably, the top nuts 130 are not immediately tightened down. Rather, the base plate 32 should first be leveled to ensure that the backboard 14 is vertical. The orientation of the base plate 32 may first be measured through the use of a construction level or a similar apparatus. Then, the intermediate nuts 124 may be individually turned through the use of a wrench to move them upward or downward on the threaded ends 120 of the J-bolts 36 to adjust the orientation of the base plate 32. The intermediate nuts 124 may be adjusted individually or in pairs to provide two-axis leveling of the basketball goal assembly 10.

After the backboard 14 has become vertical and the rim 15 has obtained a horizontal orientation, the top nuts 130 may be tightened down to prevent further motion of the base plate 32. After the intermediate nuts 124 have been adjusted, the intermediate support member 112 may be rotated to raise the intermediate support member 112 until the intermediate support member 112 abuts the bottom side 60 of the base plate 30, underneath the front span 73.

When fully assembled, the front span 73 is kept to a comparatively small size because the width 76 is comparatively small, due to the off-center position of the pole 16 with respect to the base plate 32. Additionally, the intermediate support member 112 supports the middle of the front span 73, effectively breaking the front span 73 into two shorter front spans so that no long, unsupported length exists. The front side 54 therefore effectively has two front spans, each of which is disposed between adjacent base supports, ie., between the intermediate support member 112 and each of the slots 70. As a result, when the backboard 14 is drawn forward, as by a dunking maneuver, the front span 73 cannot deflect significantly, and vibration or other undesirable motion of the pole 16 and backboard 14 is inhibited.

Downward pressure on the rim 15 exerts a moment on the juncture of the pole 16 with the base plate 32. The moment tends to bend the base plate 32 into an S-shape, with the front span 73 bowed downward and the rear span 79 bowed upward. By abutting the bottom side 60 of the front span 73 of the base plate 32, the intermediate support member 112 directly resists downward bowing of the front span 73.

If desired, a top support member (not shown) may be positioned to abut the top side 58 of the rear span 79 to restrict upward bowing of the rear span 79. Such a top support member may, for example, take the form of a bolt similar to that of the intermediate support member 112 shown in FIG. 2. The top support member may be threadably engaged within a nut coupler like the nut coupler 118, anchored within the anchoring block 34 rearward of the pole 16. However, rather than abutting the bottom side 60, the top support member may extend through an additional hole (not shown) in the base plate 32, located in the second span 79. The top support member may be tightened town after the base plate 32 has been leveled so that the top support member presses against the top side 58 of the rear span 79, thereby restricting upward bending of the rear span 79. The use of a top support member is optional; the intermediate support member 112 may alone provide significant bending resistance.

Through the use of the intermediate support member 112, the mounting assembly 30 provides such enhanced support for the base plate 32 without interfering with leveling of the base plate 32 to level the backboard 14. The intermediate nuts 124 near the first side 50 of the base plate 32 may be raised or lowered in relation to the intermediate nuts 124 near the second side 52 to permit side-to-side leveling. Similarly, the intermediate nuts 124 near the front side 54 may be raised or lowered in relation to the intermediate nuts 124 near the rear side 56 for front-to-back leveling.

An intermediate support member within the scope of the present invention need not be as shown in FIG. 2. An intermediate support member may take any form configured to abut the front span 73 in order to provide support against downward bending. For example, one or more shims (not shown) could be positioned between the template 88 and the base plate 32, underneath the front span 73. The shims could, for example, be slid under the front span 73 after the intermediate nuts 124 have been adjusted to the appropriate height. A different type of adjustable-height member, such as an expandable nut or a locking nut, may also be used; such a member may also be positioned underneath the front span 73 after adjustment of the intermediate nuts 124 and expanded to press against the base plate 32 and the template 88. Those of skill in the art will recognize that a wide variety of other devices may be employed to support the front span 73.

Figure 3:
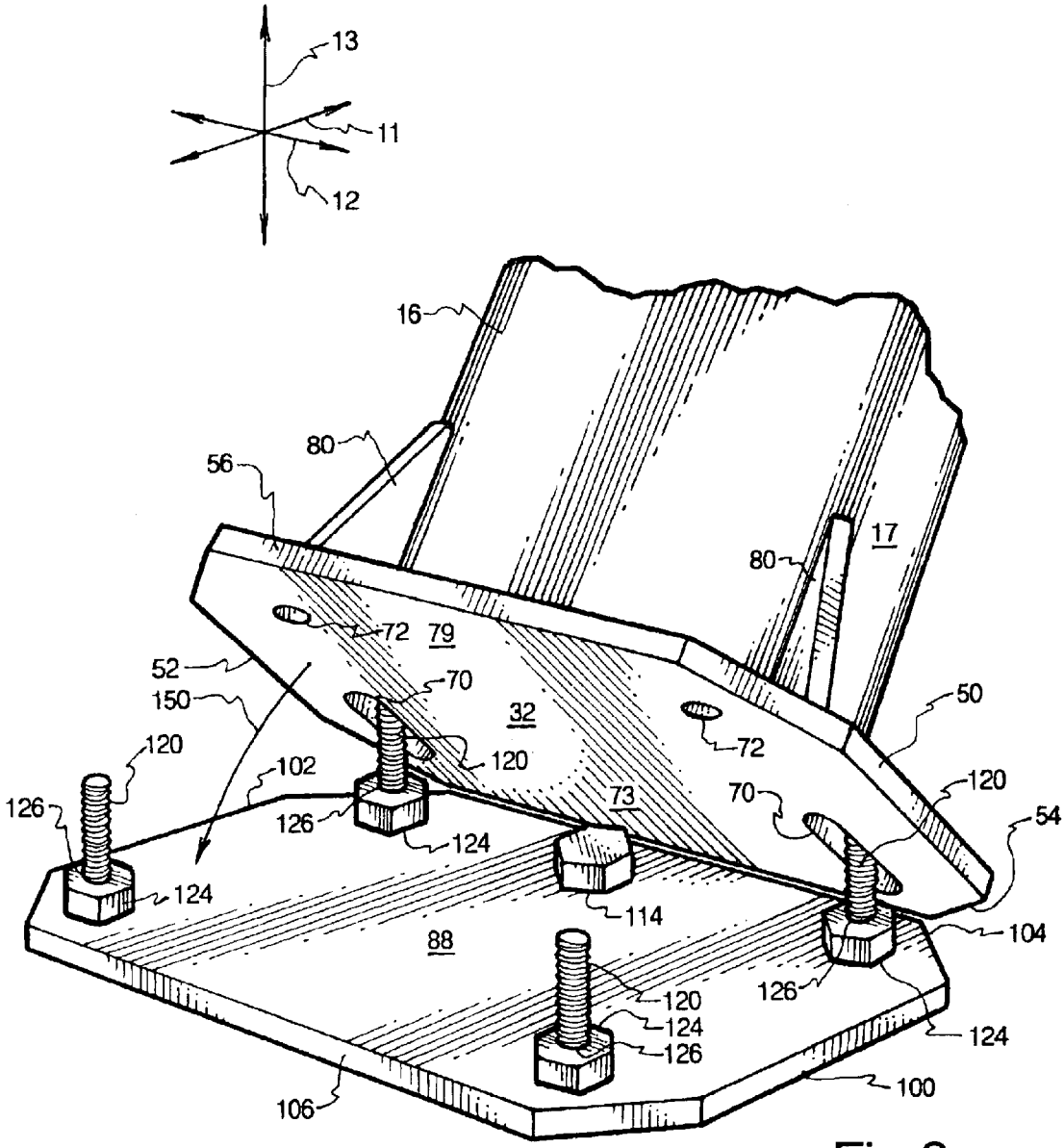
FIG. 3, is a perspective view of one method of mounting a goal assembly incorporating the mounting assembly of FIG. 1 for play.

Referring to FIG. 3, one possible method of positioning the basketball goal assembly 10 over the template 88 using the slots 70 is depicted. The basketball goal assembly 10 may first be maneuvered so that the front side 54 of the base plate 32 contacts the front side 104 of the template 88. Then, the basketball goal assembly 10 may be pivoted onto the template 88 by applying rearward pressure against the pole 16. The base plate 32 pivots onto the template 88 as indicated by the arrow 150. The slots 70 accommodate pivotal motion be cause the tops of the threaded ends 120 toward the front end 104 of the template 88 fit within the slots 70, along the full arc of motion of the slots 70 as the base plate 32 pivots. The base plate 32 may be shifted forward slightly while the holes 72 move downward so that the holes 72 travel in a nearly straight line over the threaded ends 120 toward the rear side 160 of the template 88.

The above described method is beneficial because the basketball goal assembly 10 need not be lifted and held in a vertical orientation while the basketball goal assembly 10 is lowered over the J-bolts 36. Rather, the basketball goal assembly 10 may be moved toward the anchoring block 34 in an inclined orientation. The front side 54 of the base plate 32, or at least a portion thereof, may be rested against the template 88 while the basketball goal assembly 10 is lifted into a vertical orientation. Hence, those who install the basketball goal assembly 10 need not lift the entire weight of the basketball goal assembly 10 to position the basketball goal assembly 10 on the anchoring block 34.

The same benefits may be obtained with a wide variety of base plate and hole configurations. For example, the slots 70 may instead be positioned toward the rear side 56, the first lateral side 50, or the second lateral side 54, while the circular holes 70 are positioned on the opposite side of the base plate 32. If desired, only a single slot 70 may be used. The slot 70 need not be perpendicular to a side 50, 52, 54, 56 of the base plate 32. If desired, the slot 70 may be disposed in a corner of the base plate 32, and may be oriented inward. The slots 70 may simply be oriented within the plane in which the basketball goal assembly 10 is to pivot to bring the circular holes 72 into engagement with the J-bolts 36. Such alternative configurations are contemplated by the present invention.

As long as all of the slots 70 are parallel and are disposed toward an edge of the base plate 32, and no circular holes 72 are positioned to the side of or too close to any slot 70, a portion of the base plate 32 may be rested, i.e., left substantially vertically unmoved, while the basketball goal assembly 10 is pivoted into a vertical position. Hence, a portion of the base plate 32 may be rested on the template 88, an exposed portion of the anchoring block 34, or on the ground outside the anchoring block 34 while the basketball goal assembly 10 is moved into engagement with the J-bolts 36.

Figure 4:
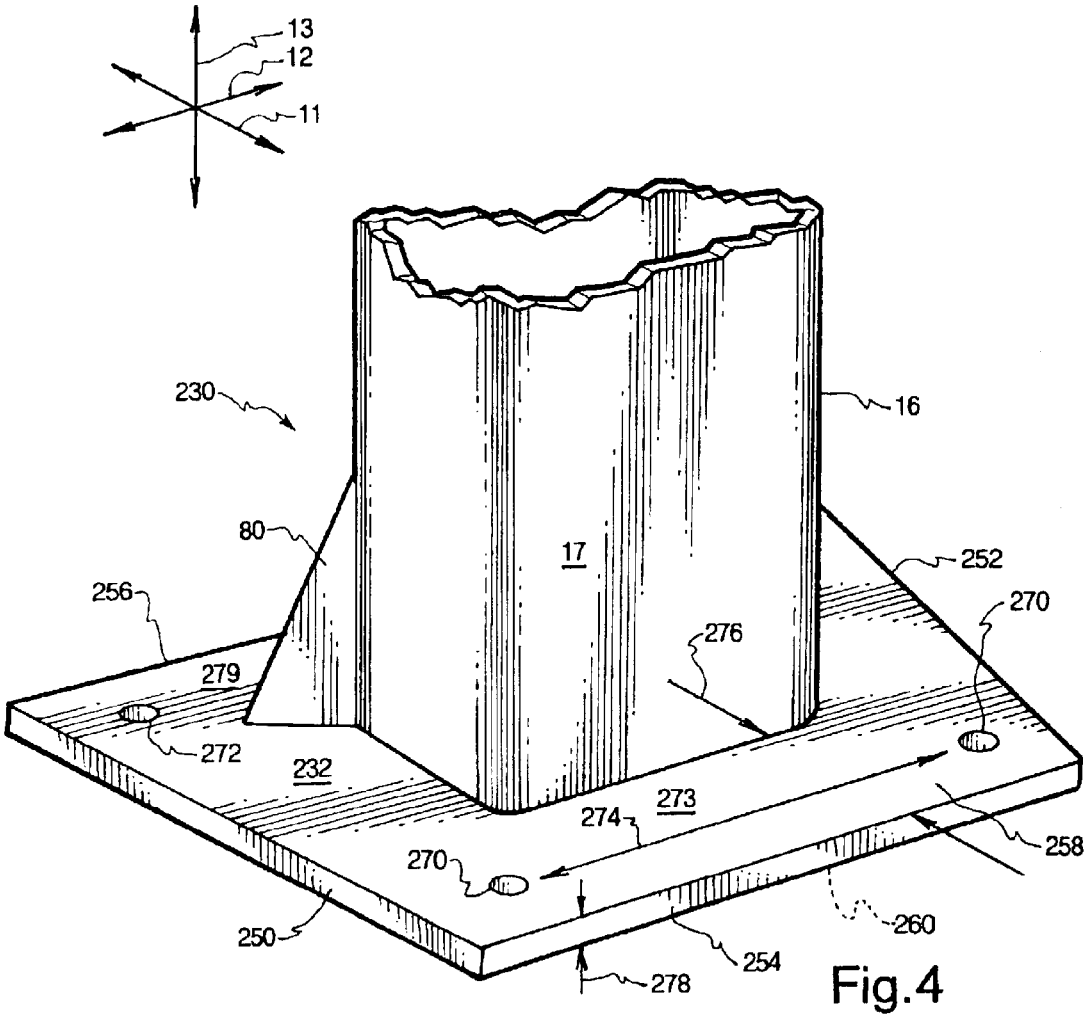
FIG. 4 is a perspective view of a base plate for an alternatively-configured mounting assembly according to the present invention.

Referring to FIG. 4, an alternative embodiment of a mounting assembly 230 suitable for the present invention is depicted. The mounting assembly 230 may have a base plate 232 with a somewhat trapezoidal shape. Like the base plate 32, the base plate 232 preferably comprises first and second lateral sides 250, 252, front and rear sides 254, 256 and top and bottom sides 258, 260. The base plate 232 may also have front holes 270 and rear holes 272. A front span 273 between the front holes 270 may have a length 274 and a width 276. A rear span 279 may similarly be located between the rear holes 270, and may have a corresponding length and width. The base plate 232 may also have a uniform thickness 278.

However, the mounting assembly 230 provides stiffening in a way somewhat different from that of the mounting assembly 232. The front span 273 is made shorter by positioning the holes 270 closer to each other, so that the length 274 is reduced. As with the front span 73, the shorter unsupported length of the front span 273 reduces bending under force against the backboard 14. As with the previous embodiment, the pole 16 may be mounted off-center on the base plate 232 so that the width 276 is shortened. Additionally, an intermediate support member (not shown) similar to the intermediate support member 112 depicted in connection with the mounting assembly 30 may be added to break the front span 273 into multiple, shorter segments that resist bending more effectively.

The trapezoidal configuration of the holes 270 may also result in a comparatively greater length of the rear span 279. This increased length may be at least partially offset via the corresponding trapezoidal shape of the base plate 232. More specifically, the trapezoidal shape of the base plate 232 may provide extra breadth, i.e., size in the lateral direction 12, and hence extra material, rearward of the pole 16. Under a given force or moment, bending displacement is generally inversely proportional to the breadth of the member; hence, the increased breadth of the base plate 232 proximate the rear side 256 helps to offset the greater length of the rear span 279.

Nevertheless, a rectangular shape like that of the base plate 32 may be preferable for use with standardized anchoring features that incorporate a rectangular shape. The base plate 232 may be made similarly rectangular; in such a case, the front holes 270 would be positioned further from the lateral sides 250, 252 than the rear holes 272. The base plate 232 may be utilized with a trapezoidal template (not shown), or with a rectangular template like the template 88.

The mounting assembly 230 of FIG. 4 may be installed in a manner somewhat similar to that of the previous embodiment. As shown in FIG. 4, the front holes 270 and the rear holes 272 are all circular in shape; hence, the base plate 232 may simply be lifted and maintained in a substantially horizontal orientation while the base plate 232 is moved downward over J-bolts that are arranged in a trapezoidal shape that corresponds to the shape of the holes 270, 272. In the alterative, one or more of the holes 270, 272 may be elongated to form slots so that the base plate 232 can be rested upon a surface such as a template and pivoted into a horizontal orientation such that all of the holes 270, 272 receive a J-bolt. As mentioned in connection with the previous embodiment, the slots and circular holes may be arranged in a wide variety of ways to permit such pivotal installation of the base plate 232.

Leveling may similarly be carried out by adjusting the vertical positions of intermediate nuts positioned below each of the holes 270 of the base plate 232. Due to the trapezoidal configuration of the holes 270, side-to-side leveling may be expected to affect the front-to-back orientation of the mounting assembly 230. However, since the front holes 270 are aligned with each other in the lateral direction 12 and the rear holes 270 are also aligned with each other in the lateral direction 12, front-to-back leveling may have little effect on side-to-side leveling. Hence, side-to-side leveling may be carried out prior to front-to-back leveling.

The present invention may be embodied in other specific forms without departing from its structures, methods, or other essential characteristics as broadly described herein and claimed hereinafter. The described embodiments are to be considered in all respects only as illustrative, and not restrictive. The scope of the invention is, therefore, indicated by the appended claims, rather than by the foregoing description. All changes that come within the meaning and range of equivalency of the claims are to be embraced within their scope.

What is claimed and desired to be secured by United States Letters Patent is:

1. A mounting assembly for a basketball goal assembly, the mounting assembly comprising:

a support member;

a base plate connected to a lower portion of the support member, the base plate including an upper surface, a lower surface, a front portion, a rear portion, a first pair of openings disposed proximate the front portion of the base plate and a second pair of openings disposed proximate the rear portion of the base plate;

a template including an upper surface, a lower surface, a front portion, a rear portion, a first pair of openings disposed proximate the front portion of the template and a second pair of openings disposed proximate the rear portion of the template;

a first pair of retaining members extending through the first pair of openings in the base plate and the first pair of openings in the template;

a second pair of retaining members extending through the second pair of openings in the base plate and the second pair of openings in the template; and an intermediate support member including a first portion disposed between the base plate and the template, the intermediate support member including a second portion inserted through an opening in the template, the intermediate support member being adjustable to abut the lower surface of the base plate.

2. The mounting assembly as in claim 1, wherein the first pair of openings in the base plate are separated by a distance that is less than a distance separating the second pair of openings in the base plate.

3. The mounting assembly as in claim 1, wherein the support member is disposed towards the first pair of openings in the base plate.

4. The mounting assembly as in claim 1, wherein the intermediate support member is disposed between the first pair of openings in the template.

5. The mounting assembly as in claim 1, wherein an upper surface of the first portion of the intermediate support member abuts the lower surface of the base plate.

6. The mounting assembly as in claim 1, wherein the first set of openings in the base plate are elongated slots.

7. The mounting assembly as in claim 1, further comprising a first set of nuts connected to the first pair of retaining members and disposed between the base plate and the template; and further comprising a second set of nuts connected to the second pair of retaining members and disposed between the base plate and the template.

8. The mounting assembly as in claim 1, wherein the intermediate support member comprises a bolt and a nut coupler.

9. A mounting assembly for a basketball goal assembly, the mounting assembly comprising:

a base plate including an upper surface, a lower surface, a front portion and a rear portion;

a first pair of openings disposed proximate the front portion of the base plate, the first pair of openings being separated by a distance;

a second pair of openings disposed proximate the rear portion of the base plate, the second pair of openings being separated by a distance, the distance between the first pair of openings in the base plate being smaller than the distance between the second pair of openings in the base plate;

a support member connected to the base plate, the support member being disposed towards the front portion of the base plate and away from the rear portion of the base plate;

a template including an upper surface, a lower surface, a front portion and a rear portion;

a first pair of openings disposed proximate the front portion of the template, the first pair of openings being separated by a distance;

a second pair of openings disposed proximate the rear portion of the template, the second pair of openings being separated by a distance, the distance between the first pair of openings in the template being smaller than the distance between the second pair of openings in the template;

a first pair of retaining members extending through the first pair of openings in the base plate and the first pair of openings in the template; and a second pair of retaining members extending through the second pair of openings in the base plate and the second pair of openings in the said mounting assembly further comprising an intermediate support member including a first portion and a second portion, the first portion being disposed between the base plate and the template, the second portion being inserted through an opening in the template, the intermediate support member being adjustable to abut the lower surface of the base plate.

10. The mounting assembly as in claim 9, wherein the intermediate support member is disposed between the first pair of openings in the template.

11. The mounting assembly as in claim 9, wherein an upper surface of the first portion of the intermediate support member abuts the lower surface of the base plate.

12. The mounting assembly as in claim 9, wherein the first set of openings in the base plate are elongated slots.

13. The mounting assembly as in claim 9, further comprising a first set of nuts connected to the first pair of retaining members and disposed between the base plate and the template; and further comprising a second set of nuts connected to the second pair of retaining members and disposed between the base plate and the template.

14. The mounting assembly as in claim 9, wherein the intermediate support member comprises a bolt and a nut coupler.

15. A mounting assembly for a basketball goal, the mounting assembly comprising:

a retaining assembly including a first pair of retaining members and a second pair of retaining members;

a template including a first pair of openings disposed towards a front portion of the template and a second pair of openings disposed towards a rear portion of the template, the first pair of retaining members being disposed within the first pair of openings in the template and the second pair of retaining members being disposed within the second pair of openings in the template;

a base plate including a first pair of openings disposed towards a front portion of the base plate and a second pair of openings disposed towards a rear portion of the base plate, the first pair of retaining members being disposed within the first pair of openings in the base plate and the second pair of retaining members being disposed within the second pair of openings in the base plate;

an intermediate support member including a first portion and a second portion, the first portion being disposed between the template and the base plate, the second portion being disposed within an opening in the template; and a support member connected to the base plate.

16. The mounting assembly as in claim 15, wherein a distance separating the first set of openings in the base is smaller than a distance separating the second set of openings in the base.

17. The mounting assembly as in claim 15, wherein the support member is disposed towards the front portion of the base.

18. The mounting assembly as in claim 15, wherein the first set of openings in the base are elongated slots.

19. The mounting assembly as in claim 15, wherein the first set of openings in the base and the second set of openings in the base have a generally trapezoidal configuration.

20. The mounting assembly as in claim 15, wherein the intermediate support member is disposed between the first pair of openings in the template.

21. The mounting assembly as in claim 15, wherein an upper surface of the first portion of the intermediate support member abuts the lower surface of the base plate.

22. The mounting assembly as in claim 15, further comprising a first set of nuts connected to the first pair of retaining members and disposed between the base plate and the template; and further comprising a second set of nuts connected to the second pair of retaining member and disposed between the base plate and the template.

23. The mounting assembly as in claim 15, wherein the intermediate support member comprises a bolt and a nut coupler.

* * * * *

UNITED STATES PATENT AND TRADEMARK OFFICE

CERTIFICATE OF CORRECTION

PATENT NO. : 6,783,472 B1
DATED : August 31, 2004
INVENTOR(S) : Carl R. Stanford et al.

It is certified that error appears in the above-identified patent and that said Letters Patent is hereby corrected as shown below:

Column 1,
Line 25, after "Accordingly," insert -- it --

Column 7,
Line 19, change "30" to -- 32 --
Line 53, after "tightened" change "town" to -- down --

Column 8,
Line 29, change "be cause" to -- because --
Line 35, change "160" to -- 106 --

Column 9,
Line 20, change "232" to -- 230 --

Column 10,
Line 8, change "270" to -- 272 --

Signed and Sealed this

Fifteenth Day of February, 2005

JON W. DUDAS
*Director of the United States Patent and Trademark Office*